US006814608B2

(12) United States Patent
Kollmann

(10) Patent No.: US 6,814,608 B2
(45) Date of Patent: Nov. 9, 2004

(54) SPRING-FORCE CLAMP CONNECTOR FOR AN ELECTRICAL CONDUCTOR

(75) Inventor: Hans-Josef Kollmann, Minden (DE)

(73) Assignee: WAGO Verwaltungsgesellschaft mbH (DE)

( * ) Notice: Subject to any disclaimer, the term of this patent is extended or adjusted under 35 U.S.C. 154(b) by 0 days.

(21) Appl. No.: 10/646,337

(22) Filed: Aug. 22, 2003

(65) Prior Publication Data

US 2004/0077210 A1 Apr. 22, 2004

(30) Foreign Application Priority Data

Aug. 22, 2002 (DE) ..... 102 39 273

(51) Int. Cl.[7] ..... H01R 4/24
(52) U.S. Cl. ..... 439/441; 439/834
(58) Field of Search ..... 439/441, 438, 439/436, 440, 834, 828, 835

(56) References Cited

U.S. PATENT DOCUMENTS 5,575,695 A * 11/1996 De Bernardis ..... 439/838
5,975,940 A * 11/1999 Hartmann et al. ..... 439/441

* cited by examiner

*Primary Examiner*—Tho D. Ta
(74) *Attorney, Agent, or Firm*—Salter & Michaelson

(57) ABSTRACT

The invention concerns a spring-force clamp connector for connecting an electrical conductor, which has a conductive core piece with a four-cornered material passage according to this design, in which the end of the clamping member of a leaf spring penetrates such that the end of the clamping member forms a clamping site for the electrical conductor together with an inner wall area of the aperture collar of the material passage. It is proposed to use for the inner wall area of the aperture collar of the material passage a new shaping with a cross edge/edge and to arrange the clamping site for the electrical conductor deep in the material passage, whereby at the same time a metal-encased conductor pre-capture pocket is formed.

6 Claims, 3 Drawing Sheets

SPRING-FORCE CLAMP CONNECTOR FOR AN ELECTRICAL CONDUCTOR

TECHNICAL FIELD

The invention relates generally to an electrical spring-force clamp connector and, more specifically, to a spring-force clamp connector with a conductive core piece and a leaf spring for connecting an electrical conductor.

BACKGROUND OF RELATED ART

A basic design feature of conventional spring-force clamp connectors is a four-cornered material passage through the conductive core piece, which is made of a flat material. This passage serves as the opening for through-passage of the conductor and has an aperture collar extending in the direction of the conductor through-passage, so that a clamping site for an electrical conductor is formed between the inner wall surface of the aperture collar and one end of a leaf spring extending through the material passage (see, for example, DE 2,825,291 C2).

Such conductive core pieces can be provided with one or even several material passages. These passages are preferably arranged in a row in order to obtain as narrow a structural shape of the conductive core piece as possible. For example, the passages may be formed as a stamped-out material strip, as is required, for example, for through-current conductive cores of closely adjacent arrangements of rows of clamp terminals. In the region of the material passages, such particularly narrow conductive core pieces only have narrow edge pieces running in the direction of the conductive core, and the current-conducting cross sections of these edge pieces are usually insufficient. This disadvantage is compensated for by the aperture collar of the material passages whose cross sections of the aperture collar are also current-conducting cross sections, so that as a whole, the cross sections of the edge pieces and the cross sections of the aperture collar make available a sufficiently large current-conducting cross section in the direction of the conductive core piece.

However, the known spring-force clamp connectors of this type have the disadvantage that the current conduction values between the inner wall areas of the aperture collar and the clamped electrical conductor are only minimally sufficient. Practical tests for solving this problem by an increase in clamping forces of the leaf spring have been unsatisfactory, since higher clamping forces unfavorably affect the manually introduced plug-in forces for clamping the electrical conductor.

SUMMARY

An object of the present invention is to maintain the advantages of a spring-force clamp connector which possesses a material passage with an aperture collar in its conductive core, but improving the current conduction values in the clamping site, without increasing the conductor plug-in forces or otherwise adversely affecting the conductor plug-in process.

In accordance with one aspect, there is provided on the inner wall area of the aperture collar, which forms the clamping site with the end of the clamping member of a leaf spring, a cross edge extending crosswise to the direction of the conductor through-passage and projecting against the electrical conductor. In addition, the clamping member of the leaf spring is dimensioned and shaped such that the end-side clamping edge of the end of the clamping member, in the position of clamping of the electrical conductor, lies approximately opposite the cross edge present at the inner wall area of the aperture collar.

Thus, the cross edge can be arranged in different positions along the extent of the aperture collar running in the direction of the conductor through-passage, while also providing a very advantageous and extremely cost-favorable embodiment in terms of technical production in that the cross edge is formed by the lower edge of the aperture collar of the material passage in the direction of the conductor through-passage. The lower edge is introduced, in a preferred embodiment, opposite the electrical conductor to be clamped, which can be produced either by an inclined arrangement of the conductive core piece overall or, for example, by upsetting or pressing or compression-molding the associated wall region of the aperture collar.

The other wall regions of the aperture collar, which contribute nothing to the formation of the clamping site, are unaffected by this measure, but can also be shaped, if this would facilitate the operating steps of technical manufacture in the production and shaping of the material passage and the aperture collar.

The solution according to the invention is novel for spring-force clamp connectors, which have a material passage with an aperture collar in their conductive core piece, and considerably improves the current transfers and contact safety in the clamping site. This results, first of all, in the advantageous formation of a contact point, which is represented as a crossing point between the electrical conductor and the projecting cross edge at the inner wall area of the aperture collar and which geometrically minimizes the contact surface between the electrical conductor and the aperture collar of the material passage to a smaller, defined contact surface. The improvements also result from a maximal introduction of contact force, which results from the fact that the clamping member of the clamping spring is dimensioned and shaped in such a way that the end-side clamping edge of the end of the clamping member, in the position of clamping of the electrical conductor, acts almost directly on the geometrically minimized contact surface, such that the clamping edge of the end of the clamping member lies roughly opposite the cross edge formed at the inner wall area of the aperture collar. There results from this a high specific pressing of the area of the contact surface, which improves the current transfers and also assures a gas-tight contact.

The positioning of the end of the clamping member of the leaf spring lying approximately opposite the cross edge at the inner wall area of the aperture collar has the further advantage that tilting moments resulting from the clamping force of the leaf spring are not exercized on the clamped electrical conductor.

If, in a preferred manner, the "projecting cross edge" is formed at the inner wall area of the aperture collar by the "introduced lower edge" of the aperture collar of the material passage, then the clamping site for the electrical conductor is maximally displaced deep into the material passage resulting in additional advantages.

Thus, in a preferred embodiment, the region of the inner wall area of the aperture collar, which extends out in front of the clamping site in the direction of plugging in the conductor, can be designed as a relatively large inclined surface and shaped shock-free with smooth transitions (preferably of planar shape). The inclined surface guides the forward end of the electrical conductor in a smooth, sliding manner (i.e., without "hard", jerking transitions) in the insertion process, so that the conductor plug-in forces are reduced and surface coatings which may be present (such as, for example, a tin coating) at the inner wall area of the aperture collar and in the region of the clamping site, are treated gently relative to undesired abrasions.

In another embodiment, a conductor pre-capture pocket for spring-force clamp connectors is disclosed that allows multiwire electrical conductors to be plugged in without problem, without fanning them out and/or otherwise managing to avoid them. In this embodiment, an end-side partial piece of the clamping member of the leaf spring is found within the contour of the material passage in the case of an uncoated and closed clamping site (i.e., it is positioned deep in the material passage) and, in fact, with a surface extent of the partial piece, which is the same size as or larger than the nominal cross section of the conductor to be clamped, such that the annular, closed inner wall area of the aperture collar forms, with the end-side partial piece of the clamping member, a conductor pre-capture pocket that is encased in metal on all sides for the forward end of the electrical conductor to be inserted. In this embodiment, the end-side partial piece of the clamping member of the leaf spring is preferably arranged so that is lies as flat as possible within the contour of the aperture collar. In this manner, a flush arrangement of the front side of the end of the clamping member is made as much as possible against the surface of the electrical conductor. As a result, if forces occur that tend to pull out the conductor, a sharp-edge conductor clamping is avoided. In addition, more sensitive, fine-wire electrical conductors can be clamped without damage.

The conductor pre-capture pocket as such bundles multiwire conductors and has the advantage for all types of electrical conductors that for a plug connection. The front end of the electrical conductor is preferably inserted first without force into the conductor pre-capture pocket and consequently is stably fixed relative to dislocation movements, before the opening of the clamping site is initiated by means of a manual axial force introduced on the conductor.

In another embodiment, a spring-force clamp connector is disclosed which easily releases the clamping site, even when the clamping site is found deep in the material passage. In this embodiment, a central partial piece of the clamping member of the leaf spring lies outside the contour of the material passage and has a front convexity in the direction of the spring clamping force of the clamping member such that a pressing tool placed on this front convexity and substantially perpendicular to the surface of the conductive core piece pushes back the clamping member up to a position in which the clamping site is completely opened. In this manner, the problem encountered in the prior art of when opening the clamping site, being able to push back the clamping member of the leaf spring far enough against its spring force so that the clamping site is optimally, (i.e., completely opened) is solved. This is particularly true if, due to a compact wiring situation, it is necessary that the tool (screwdriver) can only be displaced axially in order to open the clamping site.

A spring-force clamp connector of the present invention can be embodied both in the construction with a leaf spring designed in mirror image for two material passages arranged next to one another in a conductive core piece (see for this, the construction in DE 2,825,291 C2) as well as in a construction with a leaf spring, which has a bearing or holding piece, which can be randomly fixed at the conductive core piece (e.g., by riveting or compressing), or a construction is selected in which the leaf spring is bent in U shape and has a bearing piece at its end opposite the clamping member. The bearing piece preferably extends in the same material passage of the conductive core piece along with the clamping member of the leaf spring and is adjacent to the inner wall area of the aperture collar, which area lies opposite the inner wall area of the aperture collar that forms the clamping site.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
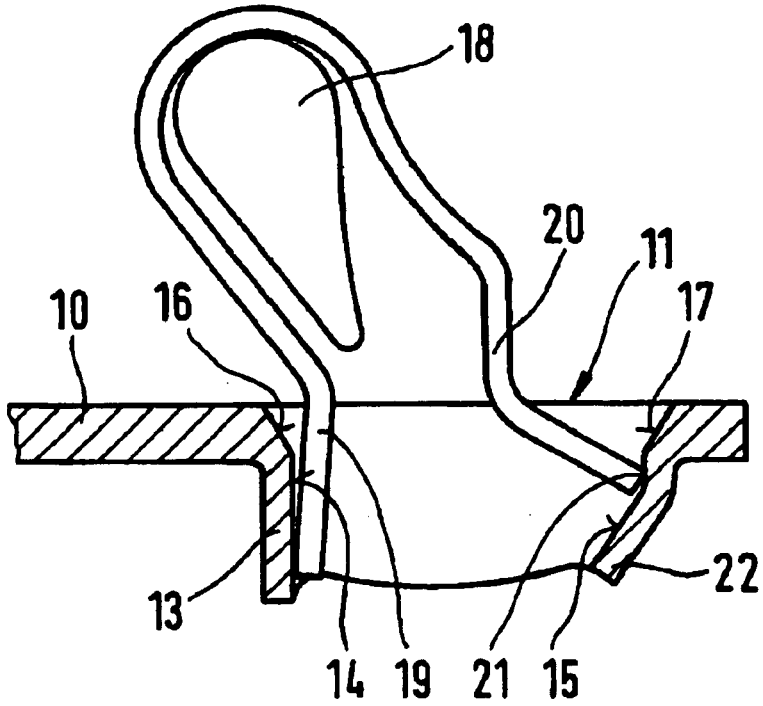
FIG. 1 is a schematic view with partial cross-section of a spring-force clamp connector according to the present invention.
Figure 2A:
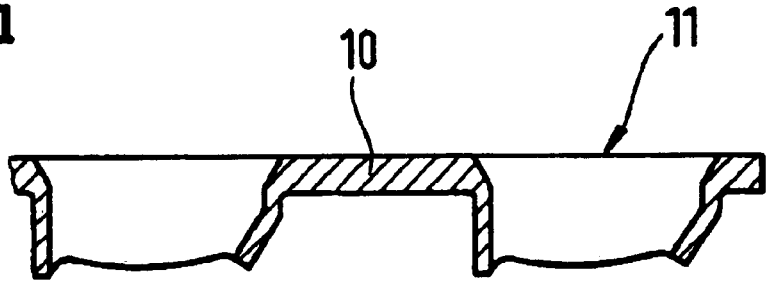
FIG. 2*a* is a schematic, enlarged side view of the spring clamp of FIG. 1.
Figure 2B:
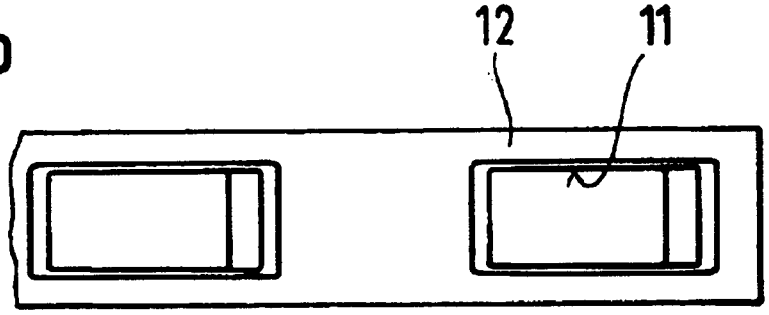
FIG. 2*b* is a schematic, enlarged top view of the spring clamp of FIG. 1.

A conductive core piece 10 including a four-cornered material passage 11 is illustrated in FIGS. 1–2*b*. As best seen in FIGS. 2*a* and 2*b*, material passages 11 of random number may preferably be positioned in a row closely adjacent to one another. The shape of a narrow strip of material, which has edge pieces 12 with a small width in the region of the material passages, can be selected for the conductive core piece.

In the present embodiment, the material passage 11 preferably includes an annular, closed aperture collar 13 having inner wall areas 14 and 15. The collar 13 is preferably condituous with the upper side of the conductive core piece. The transitions from the upper side of the conductive core piece on the inner wall areas of the aperture collar can be shaped as round or oblique lead-in places 16 and 17, respectively.

In the material passage 11, a substantially U-shaped bent leaf spring can be inserted. The leaf spring sits with its rear spring arc on a plastic projection piece 18 of a housing made of insulating material, in which such spring-force clamp connectors can be installed in the present embodiment, and is thus also fixed in position. The width of the leaf spring preferably corresponds to the width of the four-cornered passage, at least in the region of the bearing piece 19 extending into the material passage and of the clamping member 20 inserted into the material passage. Alternatively, other auxiliary measures may also be taken for additionally fixing the leaf spring in position, such as bearing shoulders of the bearing piece 19 applied at the upper side of the conductive core piece and/or, e.g., a press fit of the bearing piece in the material passage. However, in many cases of application, such additional fixing in position of the leaf spring may also be completely omitted, since the prestressing of the U-shaped leaf spring also assures a self-holding of the leaf spring in the material passage.

The end-side clamping edge 21 of the clamping member 20 is preferably applied at the uncoated and closed clamping site at the inner wall area 15 of the aperture collar and is thus held in the material passage, fixed by the stop.

According to present embodiment, a cross edge is formed, which projects at the inner wall area 15 of the aperture collar against the electrical conductor, i.e., in the direction of the center of the material passage and extending through the material passage crosswise to the conductor through-passage direction. The cross edge is preferably formed by the lower edge 22 of the aperture collar 13, which is introduced for this purpose in the direction of the center of the material passage, in the exemplary embodiment that is illustrated.

Figure 5:
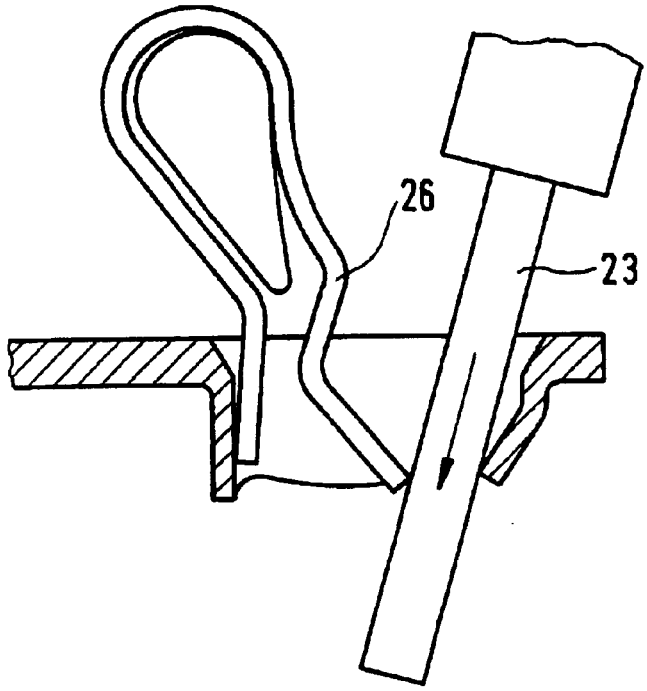
FIG. 5 is a schematic view showing operation of the spring-force clamp connector according to FIG. 1 with use as a plug connection in a third position.

The clamping member 20 of the leaf spring is also preferably dimensioned and shaped such that it maximally penetrates deep into the material passage in the position of clamping of the electrical conductor 23 (see FIG. 5). In this position, end-side clamping edge 21 lies approximately opposite the lower edge 22 of the aperture collar when the electrical conductor is clamped, so that the electrical conductor 23 is clamped free of tilting moments in the clamping site 21, 22.

Figure 3:
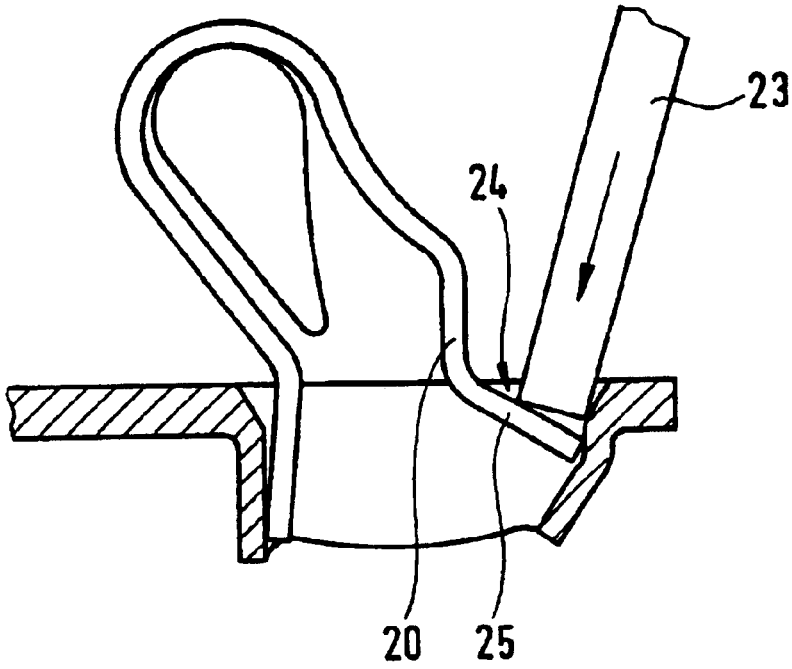
FIG. 3 is a schematic view showing operation of the spring-force clamp connector according to FIG. 1 with use as a plug connection in a first position.

The present embodiment also provides the formation of a so-called conductor pre-capture pocket 24 (see FIG. 3). The pre-capture pocket is formed due to the fact that in the uncoated and closed clamping site, the end-side partial piece 25 of clamping member 20 is found within the contour of the material passage, and, in fact, with a surface extent, which is the same size as or larger than the nominal cross section of the conductor 23 to be clamped (see also FIG. 3). The conductor pre-capture pocket 24, which is encased in metal on all sides, first permits a force-free insertion of the forward end of the electrical conductor into the capture pocket and then prevents undesired dislocation movements of the front end of the conductor, if an axial force is introduced manually on this for inserting the conductor into the clamping site (so-called plug connection).

Figure 4:
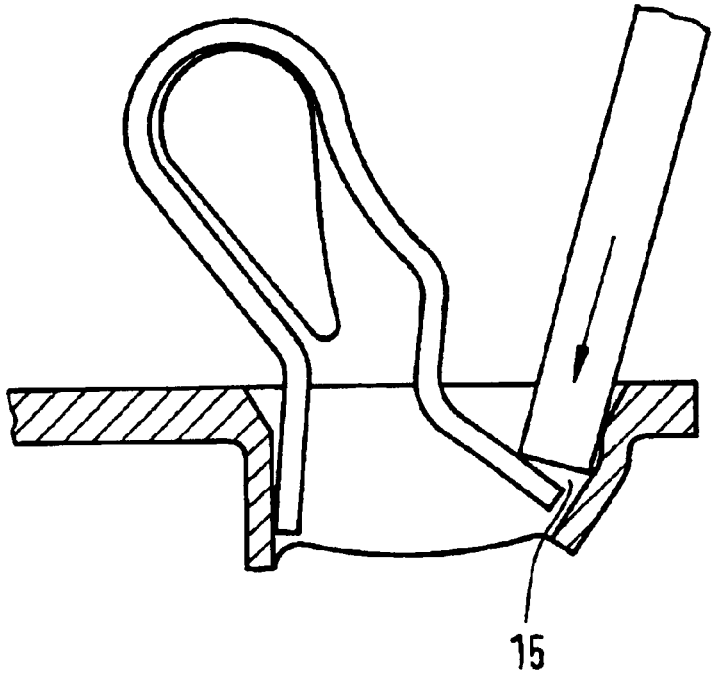
FIG. 4 is a schematic view showing operation of the spring-force clamp connector according to FIG. 1 with use as a plug connection in a second position.

Referring now to FIGS. 4 and 5, the functional sequence for plugging in the electrical conductor into the clamping site is illustrated. As shown, the shaping of the inner wall area 15 of the aperture collar as a shock-free and planar-shaped oblique surface reduces the axial force to be introduced on the electrical conductor for the plug connection.

Figure 6:
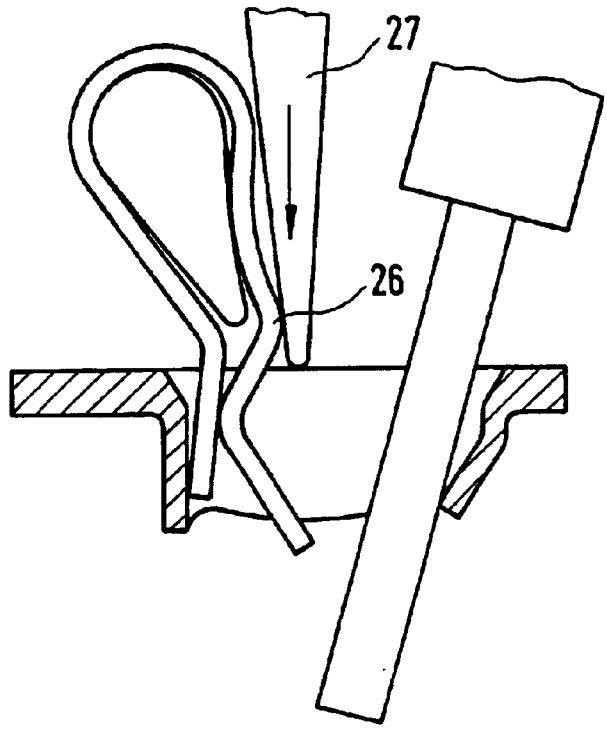
FIG. 6 is a schematic view of the spring-force clamp connector according to FIG. 1 with the clamping site opened.

The example of embodiment that is shown of a spring-force clamp connector according to the invention also takes into consideration the fact that it is necessary to be able to use spring-force clamp connectors of this type also for non-plug-type electrical conductors (e.g., for fine-wire flexible conductors) and/or to be able to release a clamped electrical conductor from the clamping site. For this purpose, the clamping member 20 of the leaf spring preferably possesses a front convexity (see FIG. 5), which is arranged outside the contour of the material passage such that a pressing tool 27 placed on this front convexity and substantially perpendicular to the upper side of the conductive core piece pushes back the clamping member up to a position in which the clamping site is completed opened (see FIG. 6).

It will be understood that various modifications may be made to the embodiments disclosed herein. Therefore, the above description should not be construed as limiting, but merely as exemplifications of preferred embodiments. Those skilled in the art will envision other modifications within the scope, spirit and intent of the invention.

What is claimed is:

1. A spring-force clamp connector for connecting an electrical conductor comprising:

a substantially planar conductive core piece having an opening comprising a four-cornered material passage constructed and arranged to receive the electrical conductor therethrough, the material passage including an aperture collar extending in the direction of the passage, the aperture collar including an inner wall;

a leaf spring including a clamping member, the clamping member having a first end that is inserted into the passage such that it forms with the inner wall of the aperture collar a clamping site for the electrical conductor;

a cross edge disposed adjacent the inner wall area of the aperture collar, the cross edge projecting against the electrical conductor and extending crosswise to the direction of the passage; and wherein the clamping member spring is constructed and arranged such that an end-side clamping edge of the clamping member lies substantially opposite the cross edge when the electrical conductor is clamped.

2. The spring-force clamp connector according to claim 1, wherein the cross edge is formed by a lower edge of the aperture collar of the material passage in the direction of the passage, and wherein the cross edge abuts the electrical conductor to be clamped.

3. The spring-force clamp connector according to claim 2, wherein the inner wall of the aperture collar adjacent the clamping site includes an inclined area with substantially smooth transitions.

4. The spring-force clamp connector according to claim 1, wherein the leaf spring has substantially a U shape and includes at a bearing piece disposed at an end on the side opposite the clamping member, the bearing piece extending with clamping member in the material passage, the bearing piece being adjacent to the inner wall area of the aperture collar, which lies opposite the inner wall area of the aperture collar that forms the clamping site.

5. A spring-force clamp connector with a substantially planar conductive core piece for connecting an electrical conductor comprising:

an opening constructed and arranged to receive the conductor therethrough, the opening having a shape of a four-cornered material passage, and further including an aperture collar extending in the direction of the passage, the aperture collar including an annular, closed wall;

a leaf spring including a clamping member, the clamping member having a first end that is inserted into the passage such that it forms with the inner wall of the aperture collar a clamping site for the electrical conductor, the clamping site having an uncoated surface;

an end-side partial piece disposed at the uncoated and closed clamping site, the partial piece being disposed within the contour of the passage, the partial piece having a surface area which is the same size as or larger than the nominal cross section of the conductor to be clamped; and wherein the annular, closed inner wall area of the aperture collar with the end-side partial piece of the clamping member forms a conductor pre-capture pocket that is encased in metal for a forward end of the electrical conductor to be inserted.

6. A spring-force clamp connector with a substantially planar conductive core piece for connecting an electrical conductor comprising:

an opening constructed and arranged to receive the conductor therethrough, the opening having a shape of a four-cornered material passage, and further including an aperture collar extending in the direction of the passage, the aperture collar including an inner wall;

a leaf spring including a clamping member, the clamping member having a first end that is inserted into the passage such that it forms with the inner wall of the aperture collar a clamping site for the electrical conductor, a central partial piece of the clamping member of the leaf spring disposed outside of the contour of the passage, the central partial piece including a front convexity in the direction of the spring clamping force of the clamping member of the leaf spring; and wherein upon a pressing tool being placed on the front convexity and substantially perpendicular to the upper side of the conductive core piece, the clamping member is pushed back to an up position in which the clamping site is completely opened.

* * * * *